US005463407A

United States Patent [19]

West et al.

[11] Patent Number: 5,463,407

[45] Date of Patent: * Oct. 31, 1995

[54] DUAL MODE/DUAL BAND FEED STRUCTURES

[75] Inventors: Laurice J. West, Ventura; Edward E. Gabrelian, Granada Hills, both of Calif.

[73] Assignee: California Amplifier, Inc., Camarillo, Calif.

[ * ] Notice: The portion of the term of this patent subsequent to Jun. 1, 2010, has been disclaimed.

[21] Appl. No.: 133,168

[22] PCT Filed: Feb. 5, 1993

[86] PCT No.: PCT/US93/01054

§ 371 Date: Oct. 13, 1993

§ 102(e) Date: Oct. 13, 1993

[87] PCT Pub. No.: WO93/16502

PCT Pub. Date: Aug. 19, 1993

Related U.S. Application Data

[63] Continuation-in-part of Ser. No. 831,900, Feb. 6, 1992, Pat. No. 5,216,432.

[51] Int. Cl.[6] ..... H01Q 13/00

[52] U.S. Cl. ..... 343/786; 343/776; 343/772

[58] Field of Search ..... 343/786, 776, 343/772, 773, 783, 784, 774; 333/21 A, 21 R; H01Q 13/00

[56] References Cited

U.S. PATENT DOCUMENTS

| | | | |
|---|---|---|---|
| 5,216,432 | 6/1993 | West | 343/786 |
| 5,331,332 | 7/1994 | West et al. | 343/786 |

*Primary Examiner*—Donald T. Hajec
*Assistant Examiner*—Hoanganh Le
*Attorney, Agent, or Firm*—Arthur Freilich; Freilich, Hornbaker & Rosen

[57] ABSTRACT

A feed structure (24) is disclosed for reception of orthogonal linearly polarized signals from communication satellites. The structure includes probes (34, 36) extended through the back wall (32) of a cavity (28) with associated transmission members (50, 52) and an associated isolation member (54). The teachings of the invention are extended to structures having the probes extended through the side wall (100) of a cavity. The teachings of the invention are further extended to dual band feed structures (124, 220 and 320). The structures are particularly suited to enhance high signal to noise ratios because of short path lengths to external receiver circuits and to enable realization in simple economical one piece castings.

40 Claims, 10 Drawing Sheets

DUAL MODE/DUAL BAND FEED STRUCTURES

This application is a continuation-in-part of U.S. application Ser. No. 831,900 filed Feb. 6, 1992, and now U.S. Pat. No. 5,216,432.

FIELD OF THE INVENTION

The present invention relates generally to antenna feeds and more particularly to feed structures for receiving orthogonal linearly polarized microwave signals.

BACKGROUND OF THE INVENTION

Microwave signals are broadcast from communication satellites in various frequency bands (e.g. C band and Ku band) to be received in television receive only (TVRO) systems. Each microwave signal is typically linearly polarized in one of two possible orientations whose electric field vectors are orthogonal to one another. Adjacent television channel signals are typically orthogonal to one another to enhance channel isolation. Orthogonal linearly polarized signals may be received by rotatable receiving systems configured for repeated alignment with the signal polarization or in fixed receiving systems designed to remain in a fixed orientation after an initial alignment. Fixed systems have become increasingly attractive as more satellites, and hence their orthogonal signals, are maintained in absolute geophysical alignment.

U.S. patents of interest in reception of orthogonal linearly polarized signals include U.S. Pat. Nos. 2,825,032; 3,358,287; 3,388,399; 3,389,394; 3,458,862; 3,573,838; 3,668,567; 3,698,000; 3,864,687; 4,041,499; 4,117,423; 4,414,516; 4,528,528; 4,544,900; 4,554,553; 4,595,890; 4,672,388; 4,679,009; 4,707,702; 4,755,828; 4,758,841; 4,862,187; 4,890,118; 4,903,037; 4,951,010; 4,996,535; 5,043,683; 5,066,958 and 5,107,274. Apparatus intended for reception of orthogonal linearly polarized signals are supplied by SPC Electronics under the designations of models DPS-710 Series and DPS-710R Series and by Pro Brand International under the designation of Aspen Eagle LNBF 1000.

SUMMARY OF THE INVENTION

The present invention is directed to feed structures for receiving orthogonal linearly polarized microwave signals.

Structures in accordance with the invention include a feed horn defining a microwave cavity with first and second probes projecting into the cavity in respective alignment with the electric field vectors of the orthogonal signals. To reduce signal coupling between the probes, an isolation member extends from the cavity back wall and is preferably centered on the cavity axis.

In a preferred embodiment, the isolation member defines a plurality of radial arms, one of which is preferably arranged to lie in the cavity quadrant bounded by the probes.

In a preferred embodiment, the probes project through the cavity side wall for direct external delivery of the received signals to amplifier circuitry adjacent the side wall.

In another preferred embodiment, the probes project through the cavity back wall for direct external delivery of the received signals to amplifier circuitry adjacent the back wall. In this embodiment each of the probes preferably terminates in the cavity in a substantially axially and longitudinally extending receive portion. Transmission members preferably at least partially surround each probe to enhance signal transmission therealong.

In accordance with a feature of the invention, each probe, after passing through the cavity wall, terminates in a launch portion where its associated signal is available. This direct path facilitates realization, in external receiver circuits, of a high signal to noise ratio.

Feed structures in accordance with the invention are particularly suited for realization in simple one piece castings and for installation as part of a fixed satellite receiving system.

The invention is extended to more than one frequency band by repeating the feed structures coaxially with dimensional scaling appropriate to each frequency band.

The novel features of the invention are set forth with particularity in the appended claims. The invention will be best understood from the following description when read in conjunction with the accompanying drawings.

DETAILED DESCRIPTION

Figure 1:
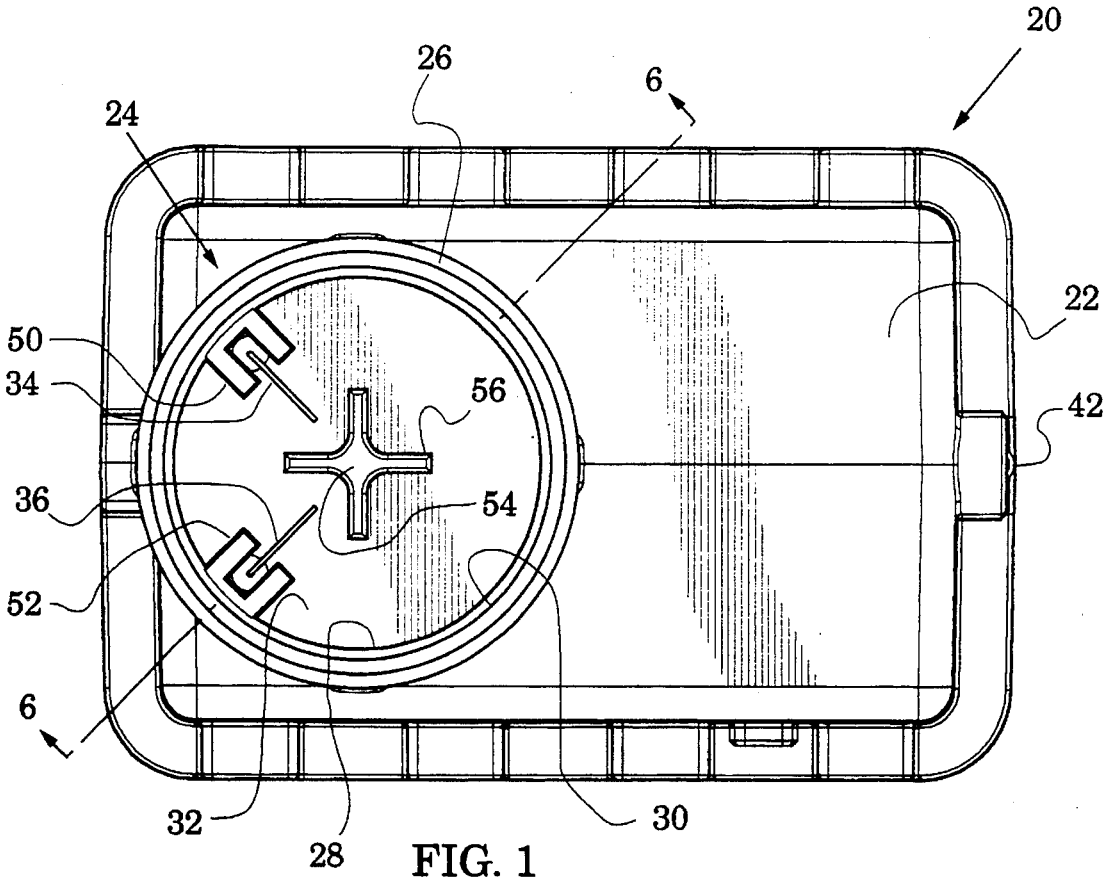
FIG. 1 is a top plan view of a feed assembly incorporating a preferred dual mode feed structure embodiment in accordance with the present invention.
Figure 2:
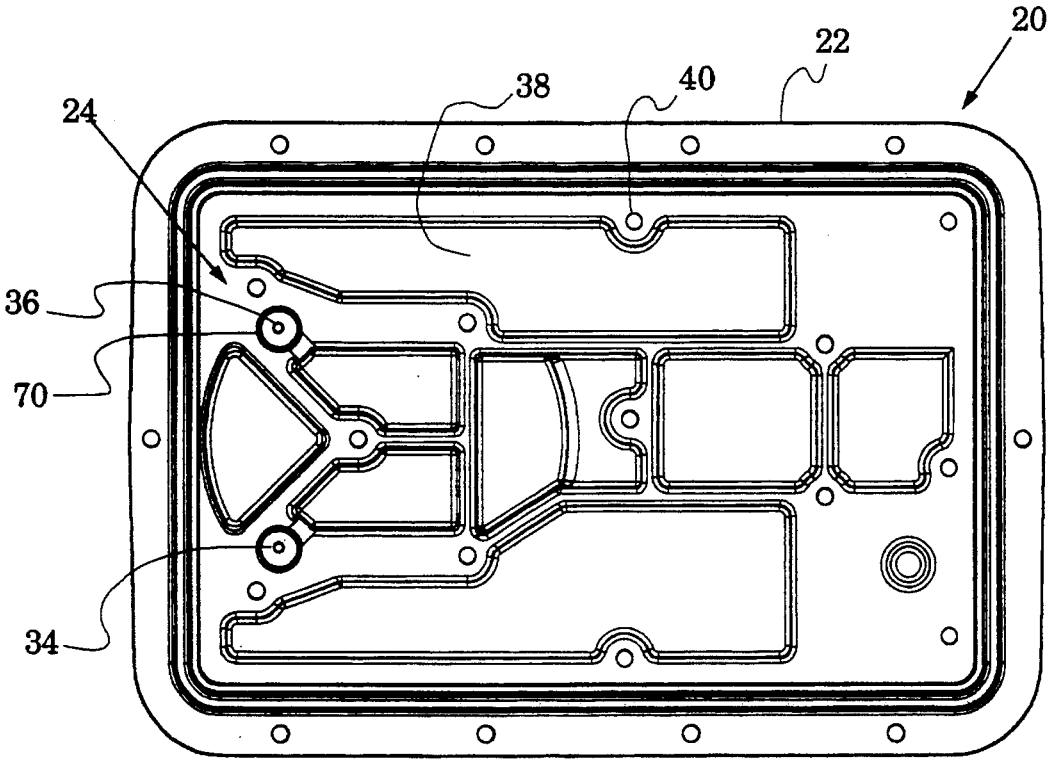
FIG. 2 is a bottom plan view of the feed assembly of FIG. 1.
Figure 4:
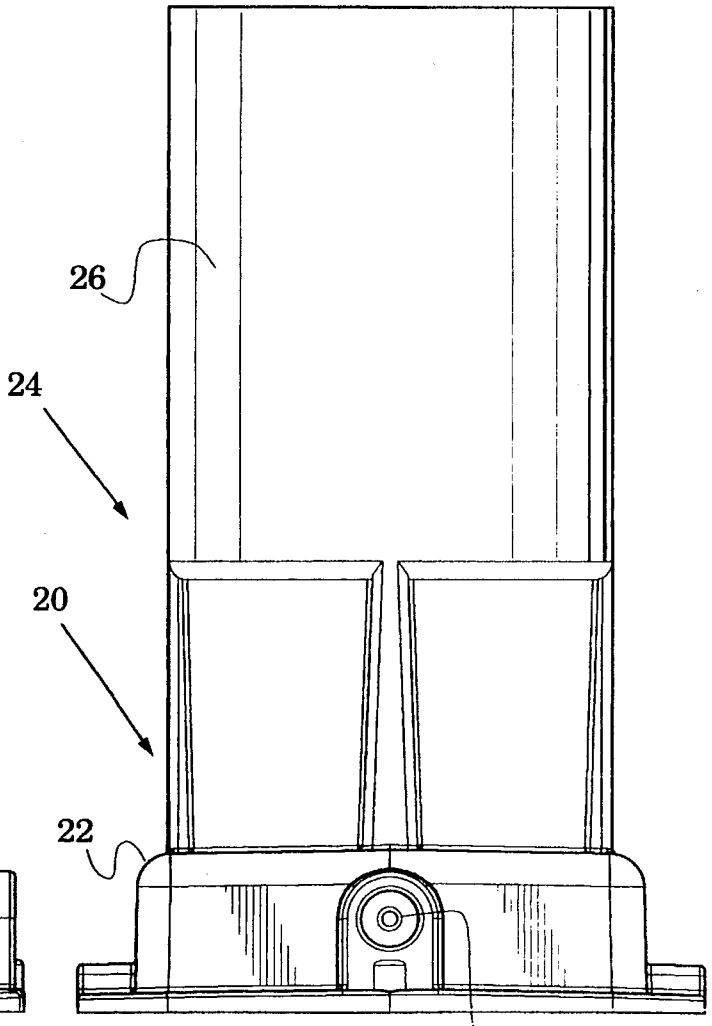
FIG. 4 is a front elevation view of the feed assembly of FIG. 1.
Figure 3:
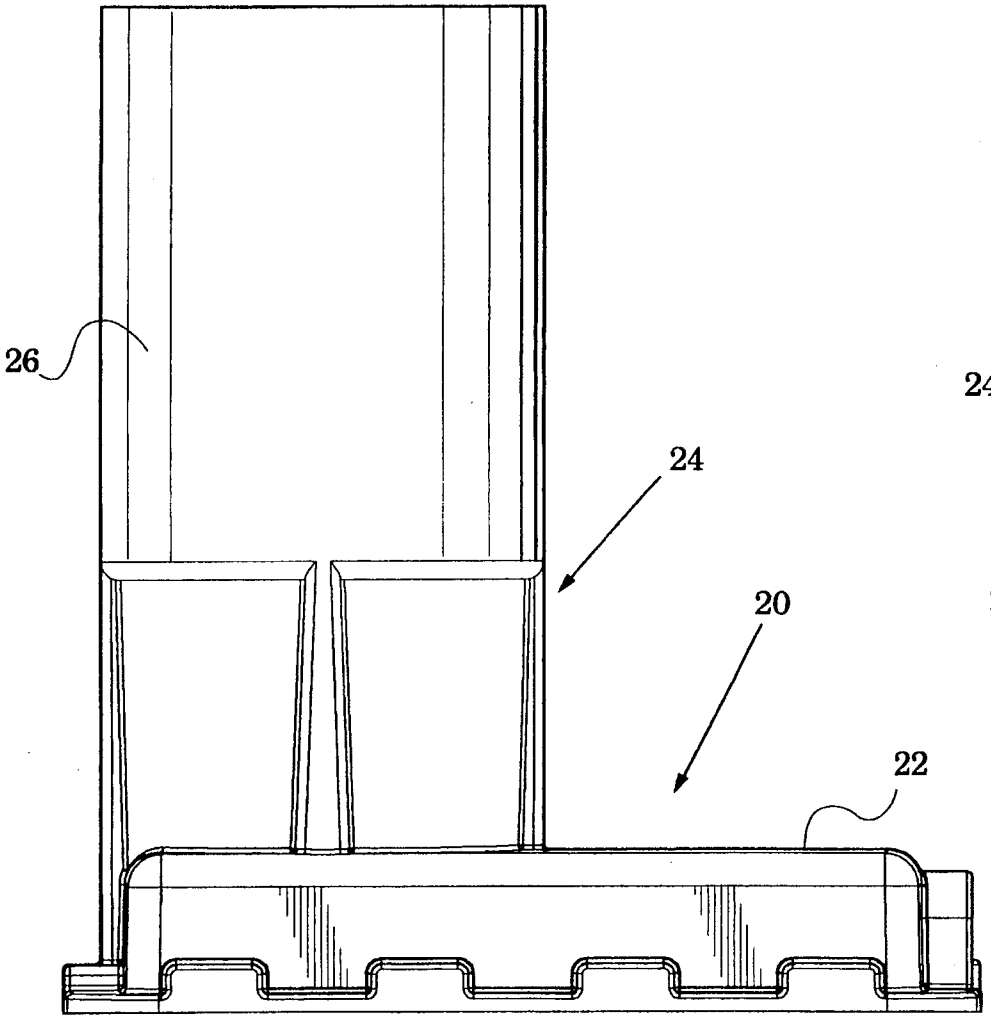
FIG. 3 is a side elevation view of the feed assembly of FIG. 1.
Figure 5:
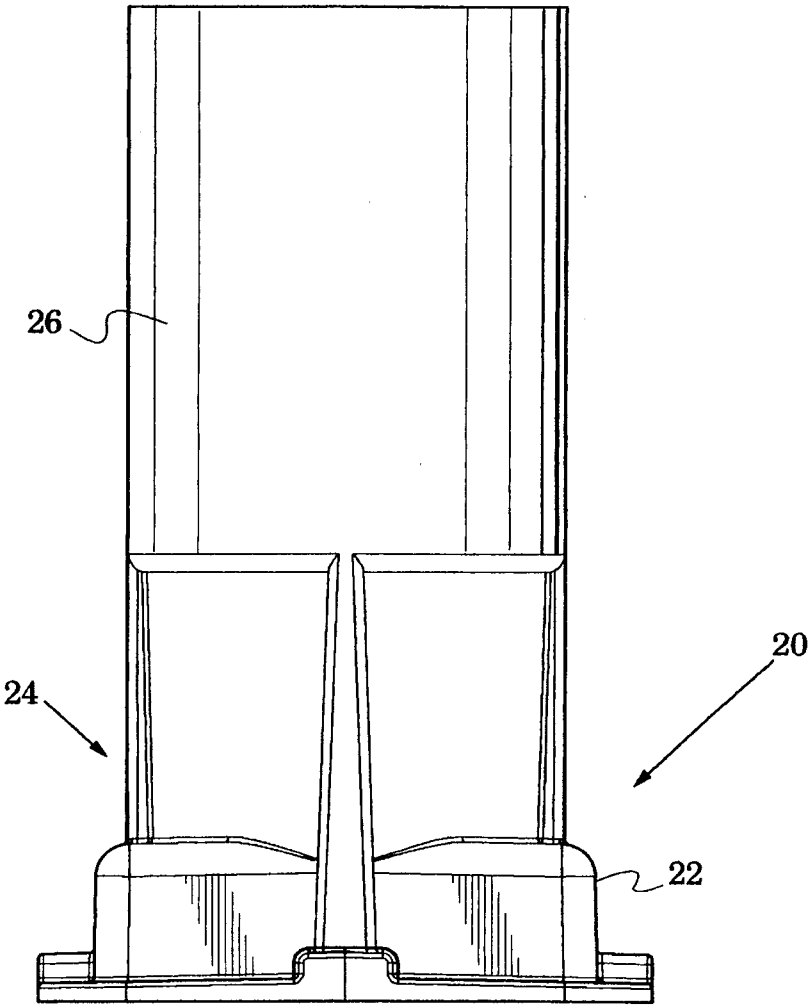
FIG. 5 is a rear elevation view of the feed assembly of FIG. 1.

A feed assembly 20 incorporating a preferred dual mode feed structure embodiment, in accordance with the present invention, for receiving orthogonal linearly polarized microwave signals is illustrated in the top plan view of FIG. 1 and further illustrated in the bottom plan view of FIG. 2, the side elevation view of FIG. 3 and the front and rear elevation views of FIGS. 4 and 5.

The feed assembly 20 includes a housing 22 which functions as a base for a feed structure 24. The feed structure 24 comprises a feed horn 26 which defines a cavity 28 having an open end 30 for the entrance of the orthogonal linearly polarized signals. The opposed end of the cavity 28 is closed with a back wall 32 supporting a pair of microwave probes 34, 36, each arranged for receiving a different one of the linearly polarized signals.

The probes 34, 36 extend through the cavity back wall 32 into a compartment 38, defined by the housing 22, where their associated signals are available to low noise amplifiers and other receiving circuits mounted on a microstrip circuit board within the housing 22 (for clarity of illustration the microstrip circuit board is not shown; threaded inserts 40, seen in FIG. 2, are provided for its installation; signals from the microstrip circuit board exit the housing 22 through housing aperture 42). The feed structure 24 also has transmission members 50, 52, configured in the form of U shaped channels, and an isolation member 54, defining radial arms 56, to facilitate the reception and transmission, along the probes 34, 36, of the signals through the back wall 32.

Thus, it may be appreciated from FIGS. 1–5, that, after an initial alignment of the probes 34, 36 with the orthogonal electric field vectors of the satellite signals, the feed structure 24 receives and presents these signals in a direct manner to external receiver circuits. The novel features of the feed structure 24 facilitate a short path length to these external receiver circuits (e.g. low noise amplifiers) to reduce additive noise and achieve a high signal to noise ratio. In addition, the feed structure 24 is particularly suited for realization in a simple, economical one piece casting, as illustrated in FIGS. 1–5, and for installation as part of a fixed satellite receiving system.

Figure 7:
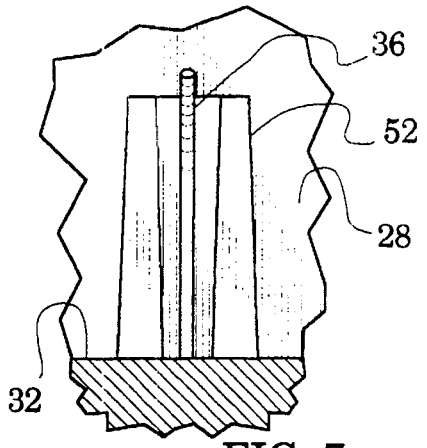
FIG. 7 is an enlarged view along the plane 7—7 of FIG. 6.
Figure 8:
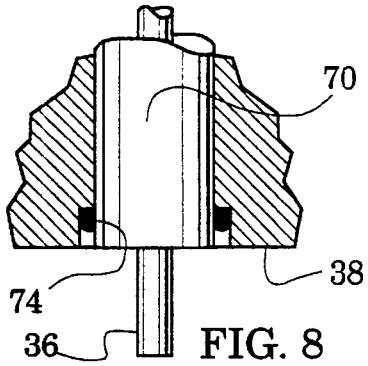
FIG. 8 is an enlarged view of the area enclosed within the line 8 of FIG. 6.
Figure 6:
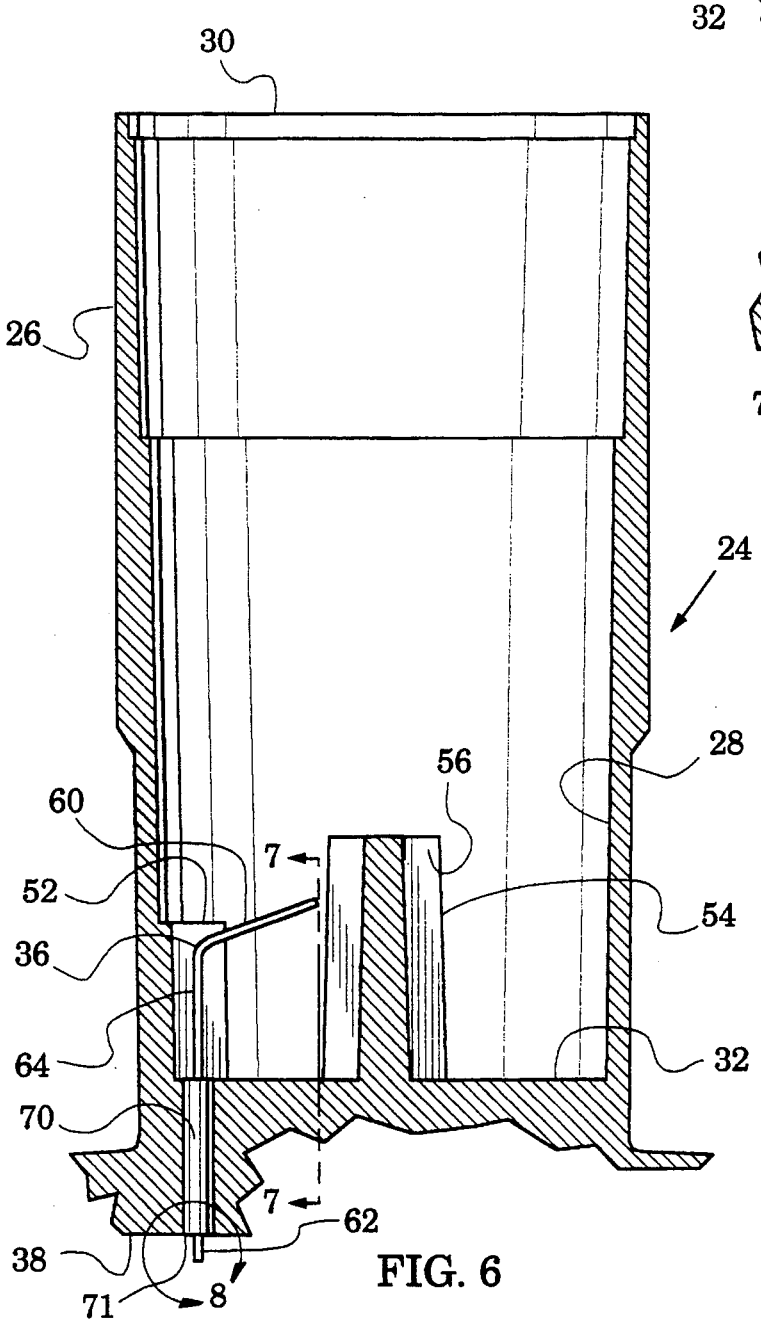
FIG. 6 is a partial view along the plane 6—6 of FIG. 1.

A more detailed description of the feed structure 24 may be obtained by reference to FIG. 6 which is a view along the plane 6—6 of FIG. 1, FIG. 7 which is an enlarged view along the plane 7—7 of FIG. 6 and FIG. 8 which is an enlarged view of the area within the line 8 of FIG. 6.

In these figures it is seen that the probe 36 (and also the probe 34) comprises a receive portion 60 that extends substantially radially and longitudinally into the cavity 28, a launch portion 62 that extends into the compartment 38 and a transmission portion 64 therebetween.

The transmission member 52 extends into the cavity 28 from the back wall 32 to partially enclose the probe 36, thereby forming, with the probe 36, a transmission structure to facilitate transmission of the associated received signal to the compartment 38. The probe 36 is isolated from the back wall 32 by a coaxial dielectric 70. In some embodiments utilizing the invention, it may be desirable to switch the external receiving circuits attached to each probe launch portion 62 between an active and an inactive state. The back wall 32, the probe 36, and the transmission member 52 may be dimensioned to transform the different impedances thus applied at the launch portion 62 to impedances suitable for the cavity 28.

Although the feed structure embodiment 24 is dimensioned for insertion of the probe 36 from the cavity open end 30, it is apparent from FIG. 6 that the open wall structure of the transmission member 52 enables other embodiments to be dimensioned to allow insertion of the probe 36 into the cavity 28 from the back wall 32 (e.g. a thinner wall 32, a larger diameter coaxial dielectric 70 and a shorter probe receive portion 60). To further facilitate this insertion, the hole 71, defined by the back wall 32 to receive the coaxial dielectric 70, may be slotted radially inward as it approaches the cavity surface of the back wall 32.

The isolation member 54 extends into the cavity 28 from the back wall 32 to reduce direct coupling of signals between the probes 34, 36 which are preferably spaced along orthogonal planes through the cavity 28 longitudinal axis. This arrangement of the probes enhances their reception of the orthogonal signals.

The isolation member 54 may be dimensioned to provide end loading to the probes 34, 36 and also present a suitable impedance to the cavity 28. The isolation member 54 may be sloped inwardly as it extends from the back wall 32 to facilitate such impedance matching and also facilitate realization of the structure as a casting. Other embodiments of the isolation member 54 may be configured as cylinders and conical frustums which may be end loaded with structures such as discs and cones.

FIG. 8 illustrates that the feed structure 24 enables the installation of an O ring 74 between the coaxial dielectric 70 and the back wall 32 for environmental protection of the receiver circuits within the housing 22.

Figure 10:
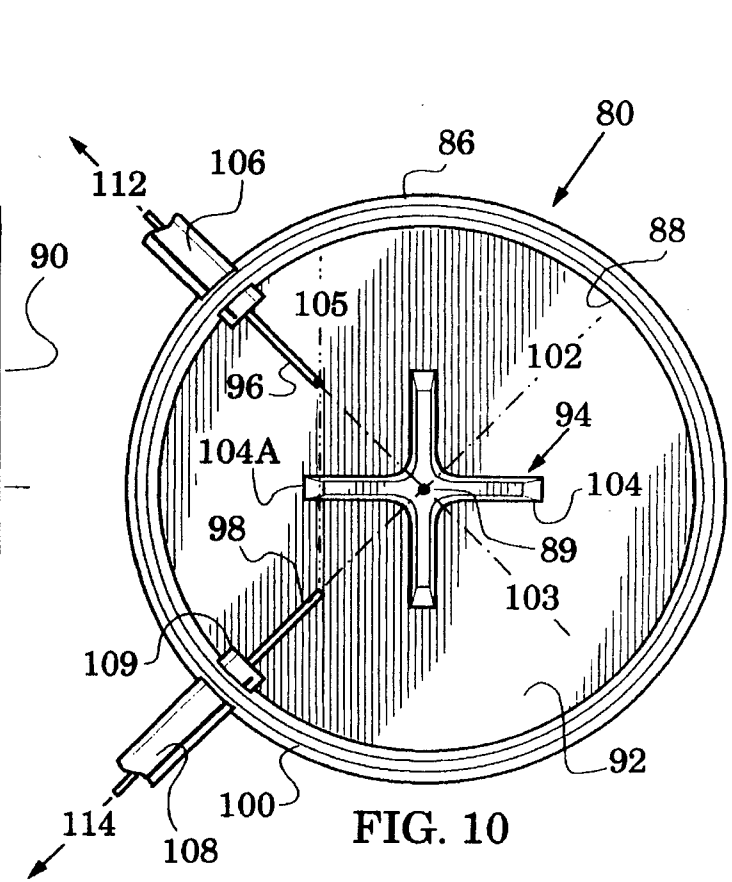
FIG. 10 is an end view of the dual mode feed structure of FIG. 9.
Figure 9:
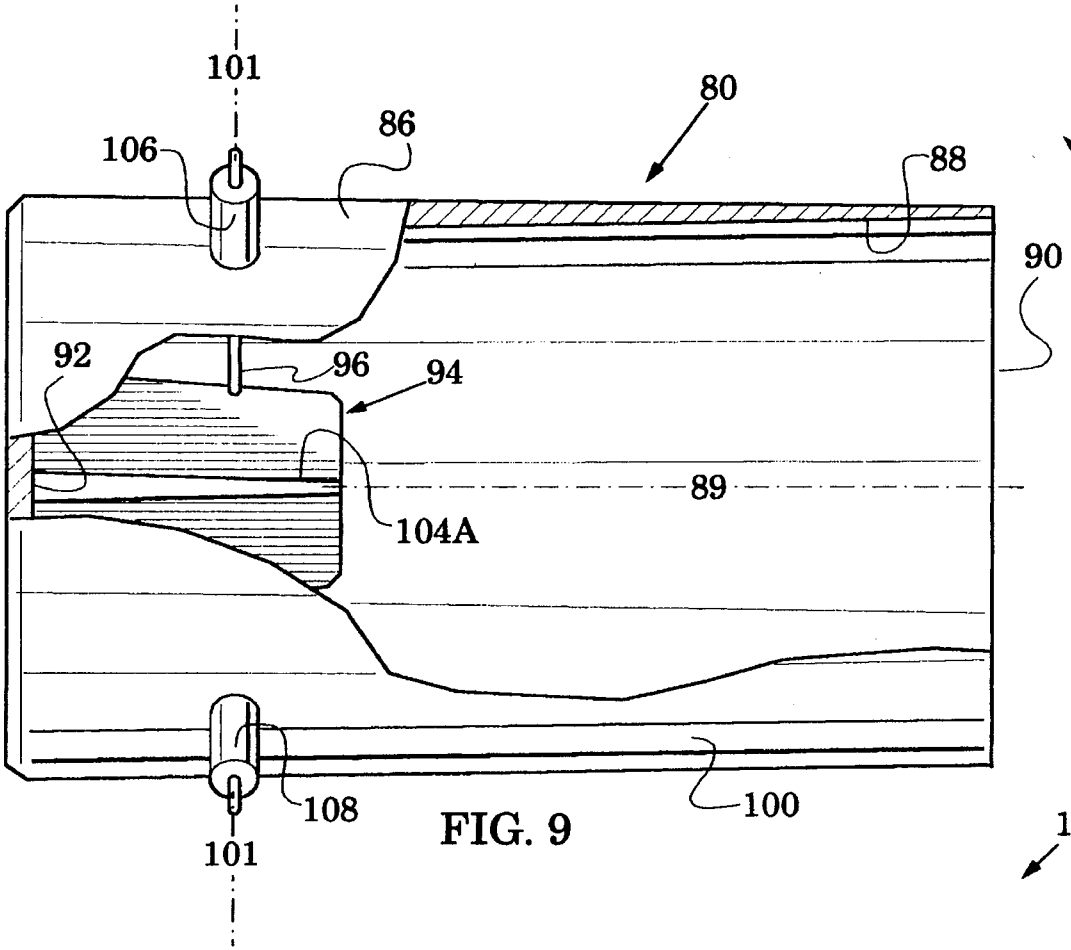
FIG. 9 is a side view of another preferred dual mode feed structure embodiment.

Attention is now directed to FIGS. 9 and 10 which are respectively side and end views of another feed structure embodiment 80 which facilitates transmission of received orthogonal signals through the structure side wall rather than the end wall as in the feed structure 24 of FIGS. 1–8.

The feed structure 80 includes a feed horn 86 which defines a cavity 88 along a longitudinal axis 89 to have an open end 90 for the entrance of the orthogonal linearly polarized signals and an opposed end closed with a back wall 92. An isolation member 94, similar to the isolation member 54 shown in FIGS. 1,6 and 7, extends into the cavity 88 from the back wall 92 and is preferably substantially centered on the axis 89.

The isolation member 94 enhances isolation between a pair of probes 96, 98 which extend into the cavity 88 through the feed horn side wall 100. The probes 96, 98 are preferably aligned along a lateral plane 101 where the orthogonal linearly polarized signals exhibit a maximum electric field strength, e.g., one quarter wave length from the back wall 92. As shown in FIG. 10 the probes 96, 98 are spaced from the cavity axis 89 along orthogonal planes 102, 103 through the axis 89.

The isolation member 94 defines radially extending arms 104. FIG. 10 shows a preferred arm configuration in which the member 94 has four orthognal arms with one arm 104A extending into the cavity quadrant defined between the probes 96, 98. To enhance isolation, the arm 104A may be extended past a line 105 connecting the ends of the probes 96, 98. As shown in FIG. 9, the isolation member 94 preferably extends from the back wall 92 past the plane 101 of the probes 96, 98.

In a preferred embodiment, the probes 96, 98 are extensions of the center conductor of coaxial shielded cables 106, 108. The outer shield 109 is cut back and electrically attached to the side wall. Although the shield 109 is shown extending slightly into the cavity 88, it may be arranged to be even with the inner cavity surface. FIGS. 9, 10 indicate tapered surfaces on the isolation member 94 and feed horn 86 which would facilitate casting this structure as an integral piece.

The embodiment 80 facilitates transmission of detected orthogonal signals to external circuits located adjacent the feed horn side wall 86 as indicated by the arrows 112, 114. Connection to these external circuits may be facilitated by terminating the center conductors of the cables 106, 108 in launcher portions similar to the launcher portion 62 of FIG. 6. Such circuits could be located immediately adjacent the feedhorn 86 to shorten the signal path length thereto, e.g., in a compartment fabricated integrally with the feedhorn.

The teachings of the invention may be extended to receive more than one satellite signal band. This is illustrated in the enlarged plan view of FIG. 11 where a feed structure 124 has a feed horn 126 defining a cavity 128 with an open end 130 and a back wall 132. Probes 134, 136, transmission members 150, 152 and the exterior surface 153 of isolation member 154 are configured within the cavity 128 as taught in the description above of the feed structure 24 (FIGS. 1–8) and are dimensioned for a first frequency band.

The internal surface of the isolation member 154 defines a second cavity 128' coaxial with cavity 128, having an open end 130', and a back wall 132' within which, probes 134', 136', transmission members 150', 152' and isolation member 154' are installed for reception of orthogonal linearly polarized signals of a second frequency band (back walls 132, 132' need not necessarily be coplanar).

As is known to those skilled in the art the dimensions of microwave structures are directly related to the signal wavelength (indirectly to the signal frequency). The dual band feed structure of FIG. 11 is dimensioned to receive two frequency bands (e.g. C and Ku band) in which the wavelengths have, approximately, a 3:1 relationship.

Figure 11:
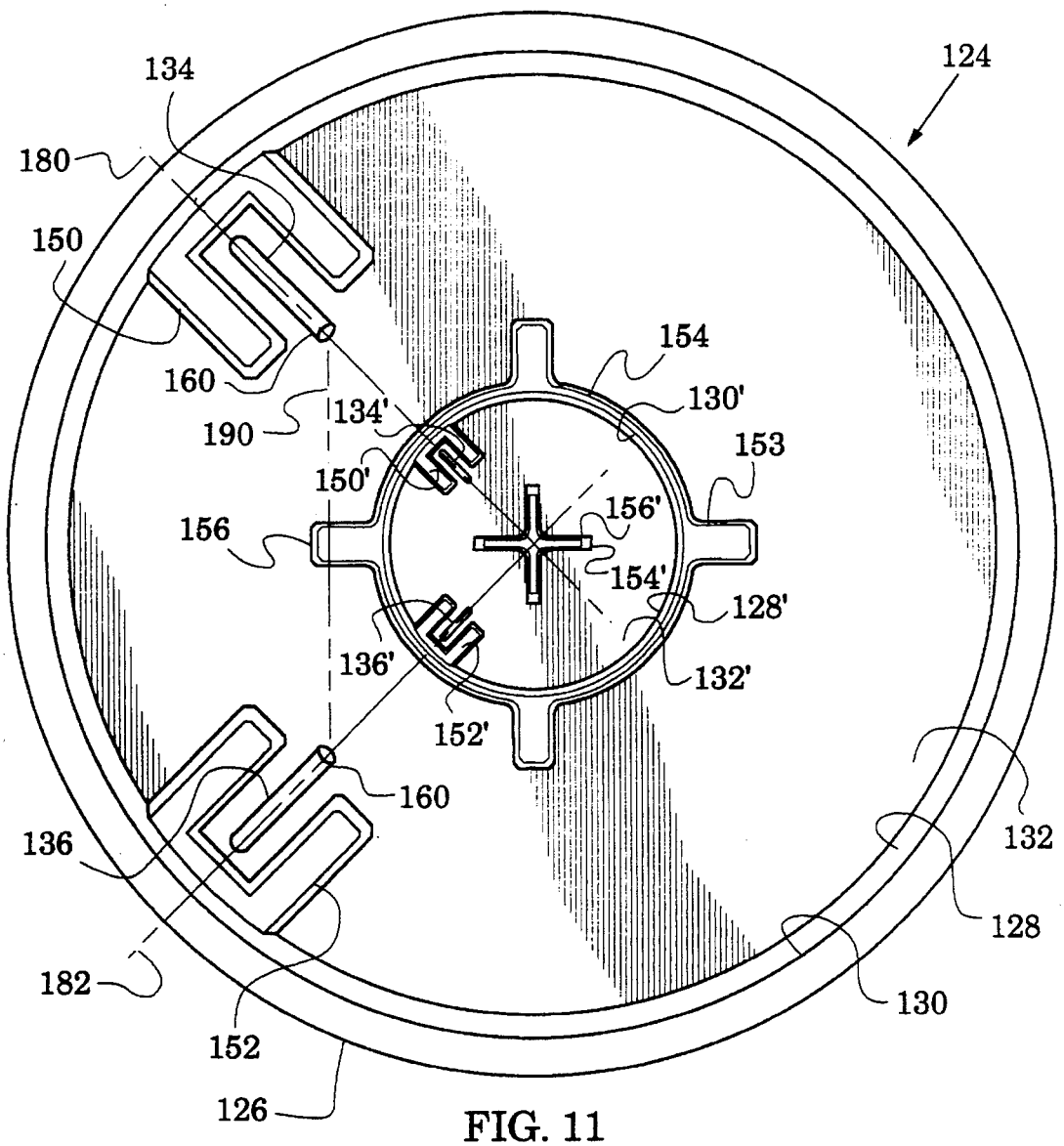
FIG. 11 is an enlarged end view of a dual mode/dual band feed structure in accordance with the present invention.

Although the cavities 128, 128' of FIG. 11 are shown to have circular cross sections to enhance illumination of a reflector (not shown), other symmetrical cavity cross sections, such as square, are also realizable. Each cavity cross section may also transition from one shape to another (as the cross section moves away from the cavity back wall) to enhance performance parameters such as reflector illumination and signal isolation (e.g. square at the back wall transitioning to circular facing the reflector).

Referring to the first frequency band structure (cavity 132, probes 134, 136, transmission members 150, 152 and isolation member 154), FIG. 11 further illustrates how each probe and associated transmission member are spaced from the cavity axis along a different one of two orthogonal planes 180, 182 arranged through the axis, while the isolation member cross section (exterior surface 153 of member 154) is substantially centered on the axis.

The feed structure 124 is configured for two frequency bands in which the orthogonal linearly polarized signals of each band are in the same alignment. If this is not the case the probes 134', 136' and associated transmission members 150', 152' would be spaced from the cavity axis along a different set of orthogonal planes through the axis.

FIG. 11 also illustrates that, similar to the feed structure 24 of FIGS. 1–8, the isolation member 154 has radial arms 156 extending away from the cavity axis. The arms 156 are arranged symmetrically to enhance impedance matching with the orthogonal signals with one of the arms extending into the quadrant defined by the cavity wall and the orthogonal planes 180, 182. This arm may extend past a line of sight 190 between the ends of the receive portion 160 of the probes 134, 136 to lower the coupling capacitance between the probes.

Figure 12:
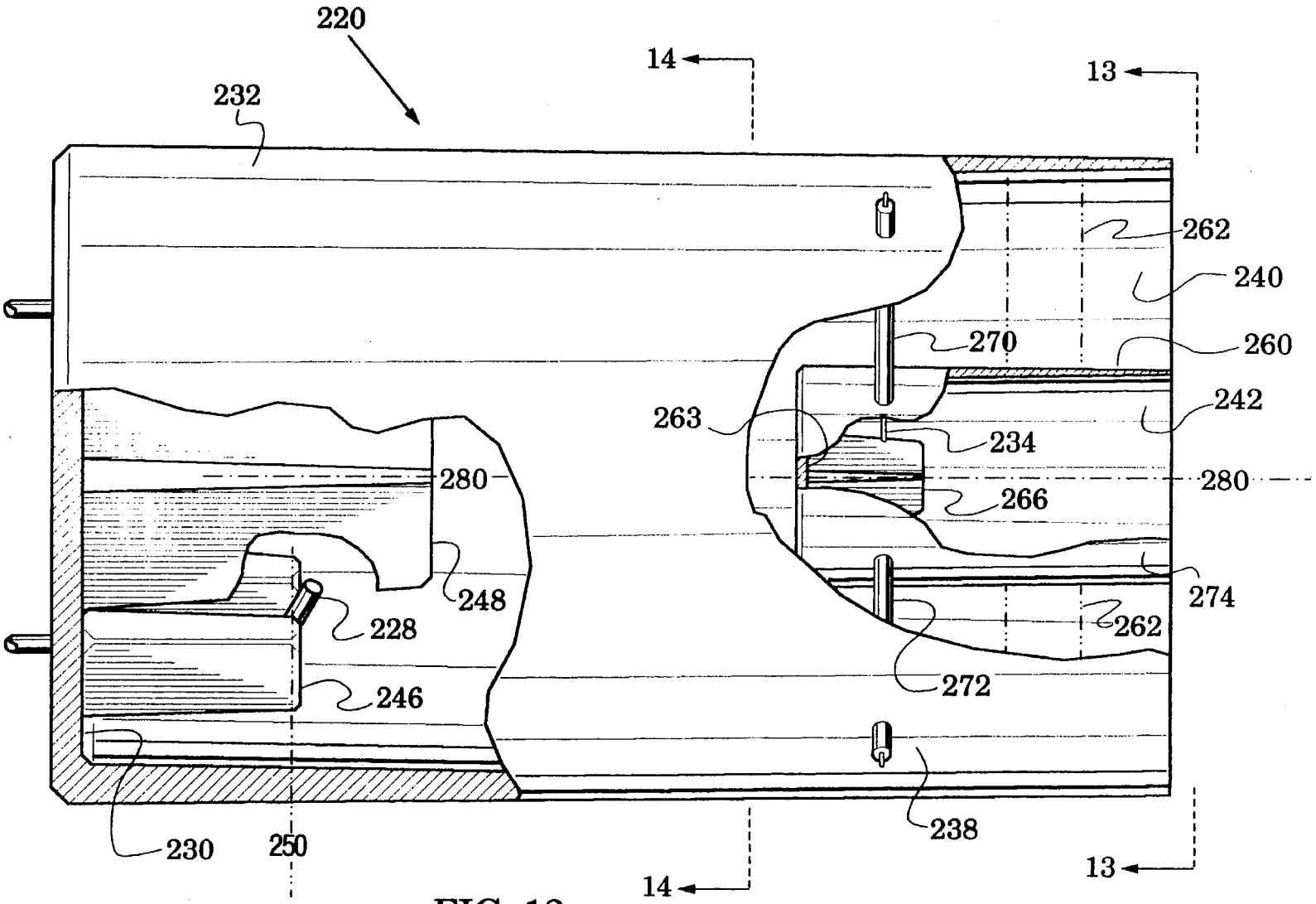
FIG. 12 is a side view of another dual mode/dual band feed structure embodiment.
Figure 13:
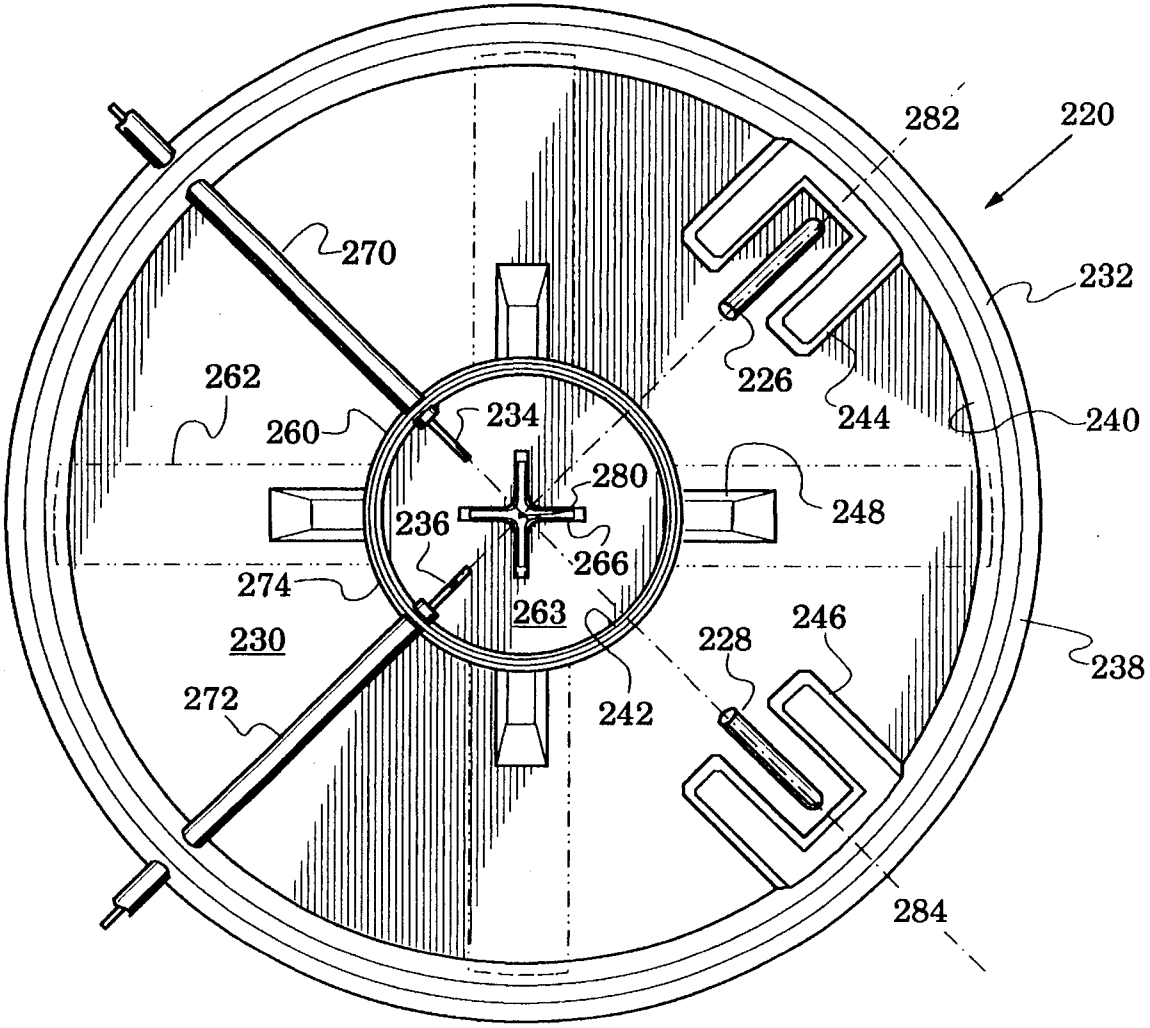
FIG. 13 is an enlarged view along the plane 13—13 of FIG. 12.
Figure 14:
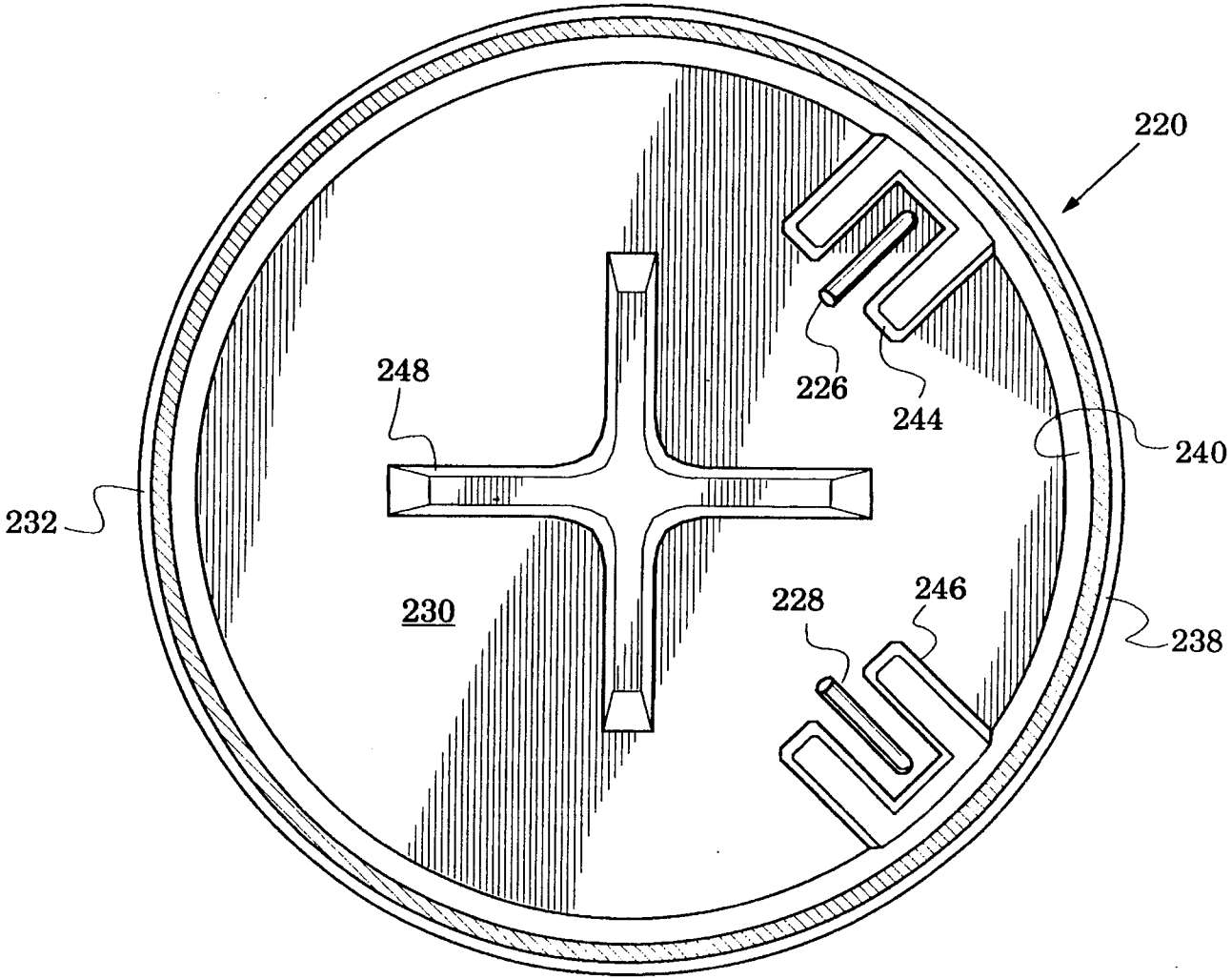
FIG. 14 is an enlarged view along the plane 14—14 of FIG. 12.

Another dual band/dual mode feed structure embodiment 220 is illustrated in the side view of FIG. 12 and in FIGS. 13, 14 which are respectively views along the planes 13—13 and 14—14 of FIG. 12. The embodiment 220 incorporates a pair of orthogonally aligned probes 226, 228 exiting through the back wall 230 of a feed horn 232 and a pair of orthogonally aligned probes 234, 236 exiting through the side wall 238 of the feed horn 232.

The probes 226, 228 are arranged within a coaxial cavity 240 for reception of orthogonal signals in a first frequency band (e.g. C band) while the probes 234, 236 are arranged within a coaxial cavity 242 for reception of orthogonal signals in a higher frequency band (e.g. Ku band). Thus, access is provided to receiver circuits in the first frequency band located adjacent the back wall 230 and receiver circuits in the higher second frequency band located adjacent the side wall 238 of the feed horn 232.

The probes 226, 228 and their associated transmission members 244, 246 and isolation member 248 are arranged in a manner similar to that taught relative to structure 124 in FIG. 11 above. The receive portion (see element 60 of probe 36 of FIG. 6) of the probes 226, 228 lie substantially in a plane 250 preferably located one quarter wave length from the back wall 230.

The cavity 242 is defined by a feed horn 260 which is coaxially supported within the feed horn 232 by any suitable dielectric structure such as the four support members 262 shown in broken lines in FIGS. 12, 13. The back wall 263 of the higher frequency feed horn 260 is spaced from the back wall 230 of the feed horn 232. This spacing is preferably greater than one half wave length of the lower signal frequency received in the feed horn 232 to enhance signal reception of the probes 226, 228.

The arrangement of the probes 234, 236 and an associated isolation member 266 within the feed horn 260 is similar to that taught relative to the feed structure 80 of FIGS. 9, 10. The probes 234, 236 are center conductors of coaxial cables 270, 272 which carry the received higher frequency signals through the side wall 274 of the feed horn 260 and through the side wall 238 of the feed horn 232.

Figure 15:
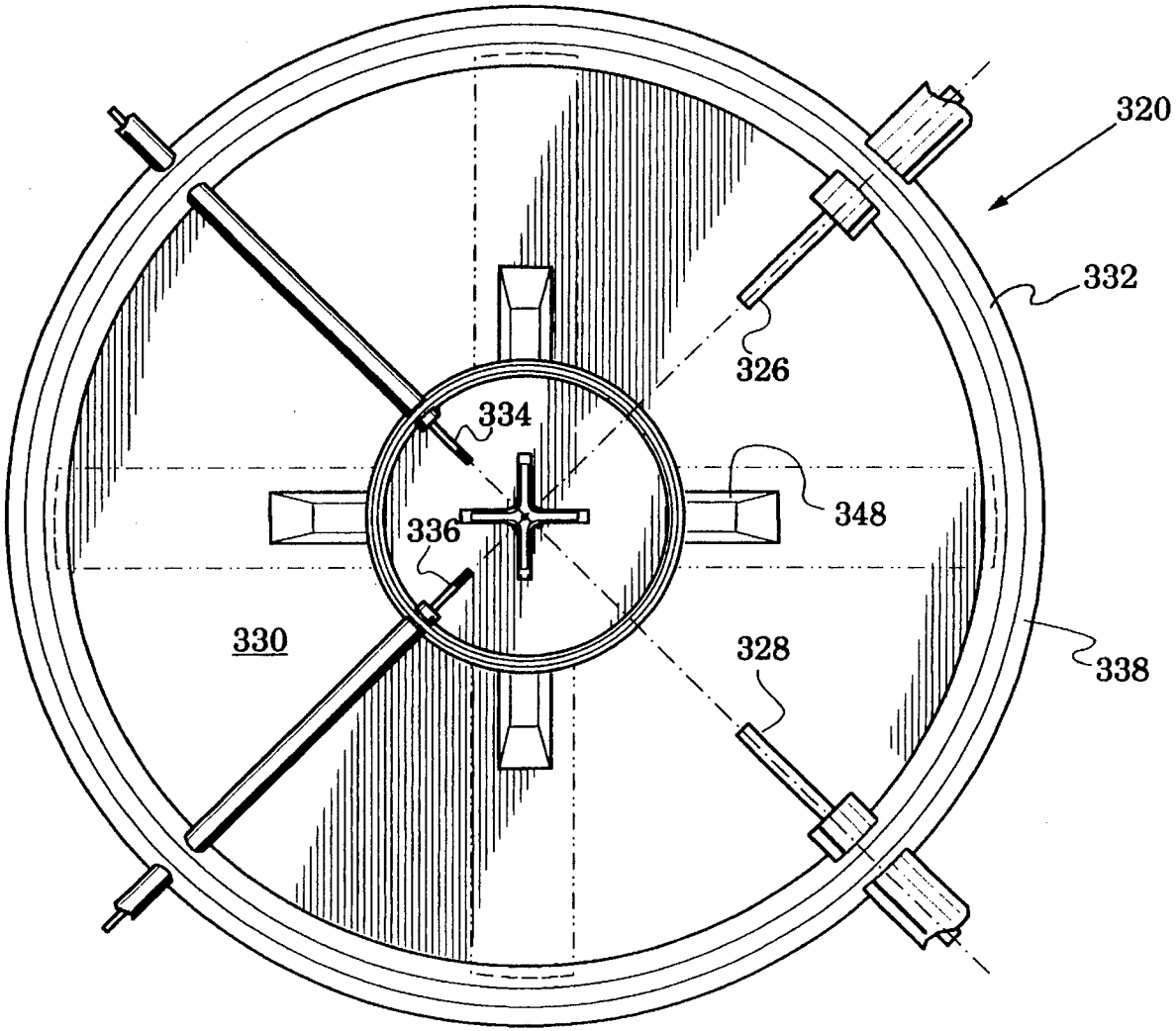
FIG. 15 is an end view, similar to FIG. 13, of another dual mode/dual band feed structure embodiment.

FIG. 15 is an end view, similar to FIG. 13, of another dual band/dual mode feed structure embodiment 320. The feed structure 320 is similar to the feed structure 220 of FIGS. 12–14 with the probes 226, 228 and their associated transmission members 244, 246 replaced by a pair of probes 326, 328 which enter through the side wall 338 of the low frequency feed horn 332 in a manner similar to that taught relative to feed horn 80 of FIGS. 9, 10. The probes 326, 328 are associated with an isolation member 348 and lie substantially in the same relation to the back wall 330 of the feed horn 332 as the receive portion of the probes 226, 228 of FIG. 12 relative to the back wall 230 of FIG. 12, i.e., plane 250.

Isolation members (54, 94, 156, 156', 248, 266 and 348) have been illustrated in FIGS. 1, 10, 11, 13, 14 and 15 to specifically have four radial arms configured quadrilaterally and with one radial arm arranged to enter the quadrant between the associated probes. In general, the teachings of the invention extend to a plurality of radial arms configured at any angle therebetween and at least one radial am arranged to enter the quadrant bounded by the associated probes.

In FIG. 11 the probes of the dual bands (134, 136 and 134', 136') have been shown positioned on the same side of the feed horn 126. In FIG. 13 the probes of the dual bands (226, 228 and 234, 236) have been shown positioned on opposite sides of the feed horn 232. In FIG. 15 the probes of the dual bands are arranged similar to that of FIG. 13. In general, for reception of dual band linearly polarized signals lying in the same orthogonal planes, the teachings of the invention extend to probes of a first feed horn arranged quadrilaterally therebetween, probes of a second higher frequency feed horn arranged quadrilaterally therebetween and all probes lying in a set of quadrilateral planes through the feed horn axes. For example, in FIG. 15, the probes 326, 328 could be rotated clockwise relative to the higher frequency probes 334, 336 in 90 degree increments. Where the signals of the dual bands do not lie in the same orthogonal planes, the orthogonally arranged probes of each band lie in the planes of their respective signals.

In other embodiments of the invention the transmission members (50, 52 in FIGS. 1–8 and 150, 152, 150', 152' in FIG. 9) may be eliminated and their function served by an integral cavity wall portion. In such embodiments it may be desirable to space the probes farther from the cavity axis to obtain additional capacitive loading from the cavity wall.

Exemplary dimensions of the preferred embodiment shown in FIGS. 1– 8, which is scaled for C band (3.7–4.2 GHz), are as follows: cavity 28 diameter=2.262" and depth to back wall 32=4.64"; probes 34, 36 diameter= 0.062"; probe transmission portion 64 extension from the back wall 32= 0.62"; probe receive portion 60 length=0.67"; probe receive portion 60 bent 70° from transmission portion 64; isolation member 54 extension from back wall 32=1.150"; isolation member arm 156 extension from cavity 28 axis= 0.430"; transmission member 50, 52 extension from back wall 32=0.700"; and transmission members 50, 52 minimum clearance from probe transmission portion 64=0.0425".

From the foregoing it should now be recognized that feed structure embodiments have been disclosed herein utilizing probes and transmission and isolation members within a cavity configured to receive orthogonal linearly polarized signals in one or more frequency bands. Apparatus in accordance with the present invention are particularly suited to facilitate direct coupling to receiver circuits for low noise reception and to facilitate realization in simple cast structures and to be installed as part of fixed satellite receiving systems.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. A dual mode feed structure for reception of orthogonal linearly polarized signals, comprising:

a feed horn defining a microwave cavity along a longitudinal axis, said cavity having a side wall and terminated at one end by a back wall and open at an opposed end for entrance of said orthogonal linearly polarized signals;

a pair of probes projecting into said cavity and spaced from said axis along a different one of two orthogonal planes through said axis for receiving a different one of said signals; and an isolation member projecting into said cavity and substantially centered on said axis, said isolation member including a radial arm extending into the quadrant, defined by said orthogonal planes, that is located between said probes.

2. The dual mode feed structure of claim 1 wherein said probes project through said back wall.

3. The dual mode feed structure of claim 2 wherein said feed horn further defines a pair of transmission members, each of said transmission members extending inward from said back wall to only partially enclose a different one of said probes and define an open side facing said axis.

4. The dual mode feed structure of claim 3 wherein each transmission member defines a U shaped transverse cross section.

5. The dual mode feed structure of claim 2 wherein each of said probes terminates in said cavity in a receive portion extending radially towards said axis.

6. The dual mode feed structure of claim 1 wherein said probes project through said side wall.

7. The dual mode feed structure of claim 1 wherein said radial arm extends past a line of sight between the ends of the probe receive portions.

8. The dual mode feed structure of claim 1 wherein the transverse cross sectional area of said isolation member decreases with increasing distance thereof from said back wall.

9. A dual mode feed structure for reception of orthogonal linearly polarized signals, comprising:

a feed horn defining a microwave cavity along a longitudinal axis, said cavity having a side wall and terminated at one end by a back wall and open at an opposed end for entrance of said orthogonal linearly polarized signals;

a pair of probes projecting into said cavity and spaced from said axis along a different one of two orthogonal planes through said axis for receiving a different one of said signals; and isolation member projecting into said cavity from said back wall and substantially centered on said axis, the cross sectional area of said isolation member decreasing with increasing distance thereof from said back wall.

10. The dual mode feed structure of claim 9 wherein said probes project through said back wall.

11. The dual mode feed structure of claim 10 wherein said feed horn further defines a pair of transmission members, each of said transmission members extending inward from said back wall to only partially enclose a different one of said probes and define an open side facing said axis.

12. The dual mode feed structure of claim 11 wherein each transmission member defines a U shaped transverse cross section.

13. The dual mode feed structure of claim 10 wherein each of said probes terminates in said cavity in a receive portion extending radially towards said axis.

14. The dual mode feed structure of claim 9 wherein said probes project through said side wall.

15. The dual mode feed structure of claim 9 wherein said isolation member defines a plurality of radial arms.

16. The dual mode feed structure of claim 9 wherein one of said arms extends radially past a line of sight between the ends of the probe receive portions.

17. A dual mode/dual band feed structure for reception of orthogonal linearly polarized signals, comprising:

a feed horn defining a first microwave cavity along a longitudinal axis, said first cavity having a first side wall and terminated at one end by a first back wall and open at an opposed end for reception of said orthogonal linearly polarized signals in a first frequency band;

a pair of first probes projecting into said first cavity and spaced from said axis along a different one of two orthogonal first planes through said axis for receiving a different one of said first frequency band signals;

a first isolation member projecting into said first cavity and substantially centered on said axis, said isolation member including a radial first arm extending into the quadrant, defined by said orthogonal first planes, that is located between said first probes, said first isolation member further defining on an interior surface thereof a second microwave cavity substantially coaxial with said first cavity, said second cavity having a second side wall and terminated at one end by a second back wall and open at an opposed end for reception of said orthogonal linearly polarized signals in a second frequency band;

a pair of second probes projecting into said second cavity and spaced from said axis along a different one of two orthogonal second planes through said axis for receiving a different one of said second frequency band signals; and a second isolation member projecting into said second cavity and substantially centered on said axis, said second isolation member including a radial second arm extending into the quadrant, defined by said orthogonal second planes, that is located between said second probes.

18. The dual mode feed structure of claim 17 wherein said first probes project through said first back wall.

19. The dual mode/dual band feed structure of claim 18 wherein said feed horn further defines a pair of first transmission members, each of said first transmission members extending inward from said first back wall to only partially enclose a different one of said first probes and define an open side facing said axis.

20. The dual mode feed structure of claim 17 wherein said first probes project through said first side wall.

21. The dual mode feed structure of claim 17 wherein said second probes project through said second back wall.

22. The dual mode/dual band feed structure of claim 21 wherein said feed horn further defines a pair of second transmission members, each of said second transmission members extending inward from said second back wall to only partially enclose a different one of said second probes and define an open side facing said axis.

23. The dual mode feed structure of claim 17 wherein said second probes project through said second side wall.

24. A dual mode/dual band feed structure for reception of orthogonal linearly polarized signals, comprising:

a feed horn defining a first microwave cavity along a longitudinal axis, said first cavity having a first side wall and terminated at one end by a first back wall and open at an opposed end for reception of said orthogonal linearly polarized signals in a first frequency band;

a pair of first probes projecting into said first cavity and spaced from said axis along a different one of two orthogonal first planes through said axis for receiving a different one of said first frequency band signals;

a first isolation member projecting into said first cavity and substantially centered on said axis, said isolation member including a radial first arm extending into the quadrant, defined by said orthogonal first planes, that is located between said first probes;

a second microwave cavity supported within said first cavity, said second cavity having a second side wall and terminated at one end by a second back wall and open at an opposed end for reception of said orthogonal linearly polarized signals in a second frequency band;

a pair of second probes projecting into said second cavity and spaced from said axis along a different one of two orthogonal second planes through said axis for receiving a different one of said second frequency band signals; and a second isolation member projecting into said second cavity and substantially centered on said axis, said second isolation member including a radial second arm extending into the quadrant, defined by said orthogonal second planes, that is located between said second probes.

25. The dual mode feed structure of claim 24 wherein said first probes project through said first back wall.

26. The dual mode feed structure of claim 24 wherein said first probes project through said first side wall.

27. The dual mode feed structure of claim 24 wherein said second probes project through said second back wall.

28. The dual mode feed structure of claim 24 wherein said second probes project through said second side wall.

29. A method of receiving orthogonal linearly polarized microwave signals, comprising the steps of:

forming a cavity about a longitudinal axis to have a side wall, to be terminated at one end by a back wall and to be open at an opposed end for reception of said orthogonal linearly polarized signals;

extending first ends of a pair of probes into said cavity wherein each of said probes is spaced from said axis along a different one of two orthogonal planes through said axis; and disposing an isolation member including a portion extending past a line of sight between said first ends of said pair of probes to project into said cavity from said back wall and be substantially centered on said axis.

30. The method of claim 29 further comprising the step of defining a radial arm on said isolation member.

31. The method of claim 29 wherein said extending step includes the step of projecting said probes through said side wall.

32. The method of claim 31 further comprising the step of disposing a pair of transmission members to extend into said cavity from said back wall, each of said transmission members only partially surrounding a different one of said probes and defining an open side substantially facing said axis.

33. The method of claim 29 wherein said extending step includes the step of projecting said probes through said side wall.

34. A method of receiving dual band/dual mode orthogonal linearly polarized microwave signals, comprising the steps of:

forming a first cavity about a longitudinal first axis to have a first side wall, to be terminated at one end by a first back wall and to be open at an opposed end for reception of orthogonal linearly polarized signals in a first frequency band;

extending first ends of a pair of first probes into said first cavity wherein each of said first probes is spaced from said axis along a different one of two orthogonal planes through said axis;

disposing a first isolation member including a portion extending past a line of sight between said first ends of said pair of first probes to project into said first cavity from said first back wall and be substantially centered on said first axis;

forming a second cavity about a longitudinal second axis to have a second side wall, to be terminated at one end by a second back wall and to be open at an opposed end for reception of orthogonal linearly polarized signals in a second frequency band;

carrying said second cavity within said first cavity;

extending first ends of a pair of second probes into said second cavity wherein each of said second probes is spaced from said second axis along a different one of two orthogonal planes through said axis; and disposing a second isolation member including a portion extending past a line of sight between said first ends of said pair of second probes to project into said cavity from said first back wall and be substantially centered on said second axis.

35. The method of claim 34 wherein said first probes extending step includes the step of projecting said first probes through said first back wall.

36. The method of claim 34 wherein said first probes extending step includes the step of projecting said first probes through said first side wall.

37. The method of claim 34 wherein said second probes extending step includes the step of projecting said second probes through said second back wall.

38. The method of claim 34 wherein said second probes extending step includes the step of projecting said second probes through said second side wall.

39. The method of claim 34 further comprising the step of defining a radial arm on said first isolation member.

40. The method of claim 34 further comprising the step of defining a radial arm on said second isolation member.

* * * * *